US012492637B2

(12) United States Patent
Allen

(10) Patent No.: US 12,492,637 B2
(45) Date of Patent: Dec. 9, 2025

(54) HYDROSTATIC SHOE WITH FACE SEAL

(71) Applicant: GOODRICH CORPORATION, Charlotte, NC (US)

(72) Inventor: Jason Bradley Allen, Waco, TX (US)

(73) Assignee: GOODRICH CORPORATION, Charlotte, NC (US)

( * ) Notice: Subject to any disclaimer, the term of this patent is extended or adjusted under 35 U.S.C. 154(b) by 72 days.

(21) Appl. No.: 18/424,263

(22) Filed: Jan. 26, 2024

(65) Prior Publication Data

US 2025/0243758 A1 Jul. 31, 2025

(51) Int. Cl.
*F01B 3/00* (2006.01)
*F04B 27/08* (2006.01)

(52) U.S. Cl.
CPC ..... *F01B 3/0073* (2013.01); *F01B 3/0044* (2013.01); *F04B 27/0886* (2013.01)

(58) Field of Classification Search
CPC ..... F01B 3/0073; F01B 3/0088; F04B 1/126; F04B 1/146; F04B 1/148; F04B 27/0886; F04B 53/14; F04B 53/147
USPC ..... 92/57, 178
See application file for complete search history.

(56) References Cited

U.S. PATENT DOCUMENTS 3,828,654 A 8/1974 Wiethoff
4,111,103 A * 9/1978 Mauch ..... F01B 3/007 91/488
4,972,675 A 11/1990 Kawahara et al.
6,675,697 B1 1/2004 Kleinedler et al.
2008/0223207 A1 9/2008 Olsen et al.
2020/0332782 A1 10/2020 Hemink

FOREIGN PATENT DOCUMENTS

CN 103062151 A * 4/2013
CN 103062151 2/2016
CN 114382672 9/2023
DE 2909248 3/1984
JP 4202832 12/2008
JP 4202832 B2 * 12/2008

OTHER PUBLICATIONS

Li et al., 'Static Pressure Balance Friction Sliding Support Oil Cylinder'—Machine Translation CN-103062151, (Apr. 2013) (Year: 2013).*
Ebara Corp, 'Axial Piston Pump or Motor'—Machine Translation JP-4202832, (Dec. 2008) (Year: 2008).*
European Patent Office, European Search Report dated Mar. 28, 2025 in Application No. 25151196.0.

* cited by examiner

*Primary Examiner* — Kenneth J Hansen
(74) *Attorney, Agent, or Firm* — SNELL & WILMER L.L.P.

(57) ABSTRACT

A shoe for use with a hydraulic piston motor or pump is disclosed herein. The shoe includes an upper portion configured to receive the hydraulic piston, a lower portion configured to contact a swashplate, a counterbore formed in the lower portion, a vertical channel extending through the upper portion and the lower portion into the counterbore, and a seal disposed within the counterbore and extending around a circumference of the counterbore.

18 Claims, 6 Drawing Sheets

HYDROSTATIC SHOE WITH FACE SEAL

FIELD

The present disclosure generally relates hydraulic piston pumps and motors, and more particularly, to shoes that are used at the end of each piston in a hydraulic piston pump or motor.

BACKGROUND

Hydraulic pistons are used in a variety of applications including in pumps and motors. For example, hydraulic piston motors are used in the nose landing gear of some aircraft to turn the nose landing gear while taxiing. Some hydraulic piston pumps and motors include a cylinder block that houses multiple hydraulic pistons and each hydraulic piston that interfaces with and moves along a swashplate. In some hydraulic piston motors the hydraulic pistons are extended and retracted so that the piston heads interface with the swashplate to rotate the cylinder barrel and generate a torque on an output shaft. In some hydraulic piston pumps, torque is applied to an input shaft that rotates the cylinder barrel causing the hydraulic pistons to move along the swashplate to extend or retract. Some hydraulic piston motors and pumps further include a shoe that provides an interface between the hydraulic piston and the swashplate to reduce friction and wear on the hydraulic piston.

SUMMARY

A shoe for use with a hydraulic piston is disclosed herein. The shoe includes an upper portion configured to receive the hydraulic piston, a lower portion configured to contact a swashplate, a counterbore formed in the lower portion, a vertical channel extending through the upper portion and the lower portion into the counterbore, and a seal disposed within the counterbore and extending around a circumference of the counterbore.

In various embodiments, the seal includes a face seal and an elastomeric seal, wherein the face seal is configured to contact the swashplate and the elastomeric seal is disposed between the face seal and the lower portion. In various embodiments, the face seal is annular having an inner circumference and an outer circumference. In various embodiments, the face seal includes a groove formed around a middle circumference of the face seal, the middle circumference being between the inner circumference and the outer circumference and a channel extending from the inner circumference to the groove. In various embodiments, the face seal is comprised of a low friction material.

In various embodiments, the seal is a C-shaped seal, the C-shaped seal having an opening toward a center of the counterbore. In various embodiments, the C-shaped seal is comprised of a low friction material. In various embodiments, the shoe further includes a channel formed in the lower portion and extending from an outer wall of the lower portion to the counterbore. In various embodiments, the shoe further includes an extension that extends into the counterbore from an upper surface of the counterbore, wherein the extension is annular, wherein the seal is disposed between the extension and an outer wall of the counterbore, and the extension is configured to prevent lateral movement of the seal. In various embodiments, the extension includes a plurality of discrete extensions. In various embodiments, the upper portion is cylindrical having a first diameter, the lower portion is cylindrical having a second diameter that is greater than the first diameter, and the counterbore has a third diameter that is less than the second diameter.

Also disclosed herein is a hydraulic piston motor including a swashplate, a plurality of pistons configured to engage the swashplate, and a plurality of shoes disposed between the swashplate and the plurality of pistons. Each shoe includes an upper portion configured to receive a piston of the plurality of pistons, a lower portion configured to contact the swashplate, a counterbore formed in the lower portion, a vertical channel extending through the upper portion and the lower portion into the counterbore, and a seal disposed within the counterbore and extending around a circumference of the counterbore.

In various embodiments, the seal includes a face seal and an elastomeric seal, wherein the face seal is configured to contact the swashplate and the elastomeric seal is disposed between the face seal and the lower portion. In various embodiments, the face seal is annular having an inner circumference and an outer circumference. In various embodiments, the face seal includes a groove formed around a middle circumference of the face seal, the middle circumference being between the inner circumference and the outer circumference, a channel extending from the inner circumference to the groove. In various embodiments, the face seal includes a low friction material.

In various embodiments, the seal is a C-shaped seal, the C-shaped seal having an opening toward a center of the counterbore. In various embodiments, the C-shaped seal includes a low friction material. In various embodiments, the hydraulic piston motor further includes a channel formed in the lower portion and extending from an outer wall of the lower portion to the counterbore. In various embodiments, the hydraulic piston motor further includes an extension that extends into the counterbore from an upper surface of the counterbore, wherein the extension is annular, wherein the seal is disposed between the extension and an outer wall of the counterbore, and the extension is configured to prevent lateral movement of the seal.

In various embodiments, the extension includes a plurality of discrete extensions. In various embodiments, the upper portion is cylindrical having a first diameter, the lower portion is cylindrical having a second diameter that is greater than the first diameter, and the counterbore has a third diameter that is less than the second diameter.

The foregoing features and elements may be combined in any combination, without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

Figure 1:
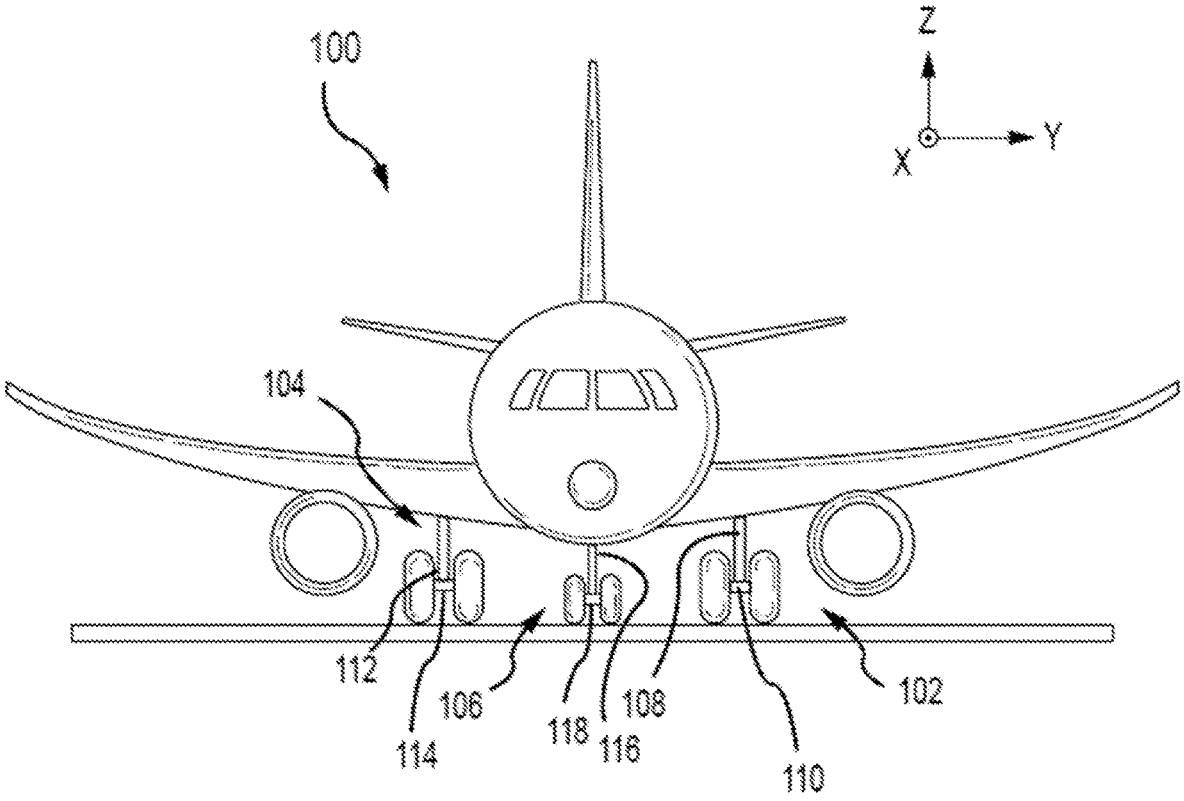
FIG. 1 illustrates an exemplary aircraft having landing gear, in accordance with various embodiments.

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. While these exemplary embodiments are described in sufficient detail to enable those skilled in the art to practice the invention, it should be understood that other embodiments may be realized and that logical, chemical and mechanical changes may be made without departing from the spirit and scope of the invention. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Hydraulic piston pumps and motors generally include shoes that are coupled at the end of each piston and ride against a swashplate. Shoes tend to incorporate hydrostatic bearing features to reduce the net forces and friction between the shoe and the swashplate. The hydrostatic bearing may be used to balance the forces of the hydraulic piston and swashplate to keep the shoe in contact with the swashplate while reducing the overall friction of the shoe against the swashplate. The use of the hydrostatic bearing tends to increase volumetric losses of the hydraulic fluid due to leakage from the shoe. In applications having high rates of rotation the volumetric loss tends to be insignificant.

Disclosed herein is a shoe for use with hydraulic piston pumps and motors that improves the performance of the shoe while decreasing volumetric losses of the hydraulic fluid. In various embodiments, the shoe disclosed herein may be used in applications having lower rates of rotation for which fluid leakage is more significant. Low-speed hydraulic piston motors or pumps tend to be more sensitive to internal leakage since leakage is a large percentage of the inlet flow rate.

In various embodiments, the shoe may include a hydrostatic bearing at the bottom of the shoe. In various embodiments, the shoe further includes a face seal within the hydrostatic bearing. In various embodiments, the face seal includes a low friction cap strip around an inner diameter of the hydrostatic seal. In various embodiments, the face seal includes an elastomeric seal between the cap strip and bottom surface of the shoe. In various embodiments, the face seal may be a preloaded C-shaped seal. In various embodiments, the face seal may be configured to provide hydrostatic pressure to the swashplate.

In various embodiments, the shoe described herein tends to reduce or eliminate shoe leakage thereby improving volumetric efficiency of the hydraulic piston pump or motor. In various embodiments, the improvement in volumetric efficiency may be increased in low-speed motors that are used in nose wheel steering applications as compared to high speed motors. In various embodiments, the shoe disclosed herein tends to decrease shoe wear. In various embodiments, the cap-strip of face seal may be partially force balanced to reduce seal friction and wear.

Referring now to FIG. 1, an aircraft 100 is illustrated, in accordance with various embodiments. In accordance with various embodiments, aircraft 100 may include one or more landing gear assemblies, such as, for example, a left landing gear assembly 102 (or port-side landing gear assembly), a right landing gear assembly 104 (or starboard-side landing gear assembly) and a nose landing gear assembly 106. Each of left landing gear assembly 102, right landing gear assembly 104, and nose landing gear assembly 106 may support aircraft 100 when not flying, allowing aircraft 100 to taxi, takeoff, and land safely and without damage to aircraft 100. In various embodiments, left landing gear assembly 102 may include a left shock strut assembly 108 and a left wheel assembly 110, right landing gear assembly 104 may include a right shock strut assembly 112 and a right wheel assembly 114, and nose landing gear assembly 106 may include a nose shock strut assembly 116 and a nose wheel assembly 118.

Figure 2:
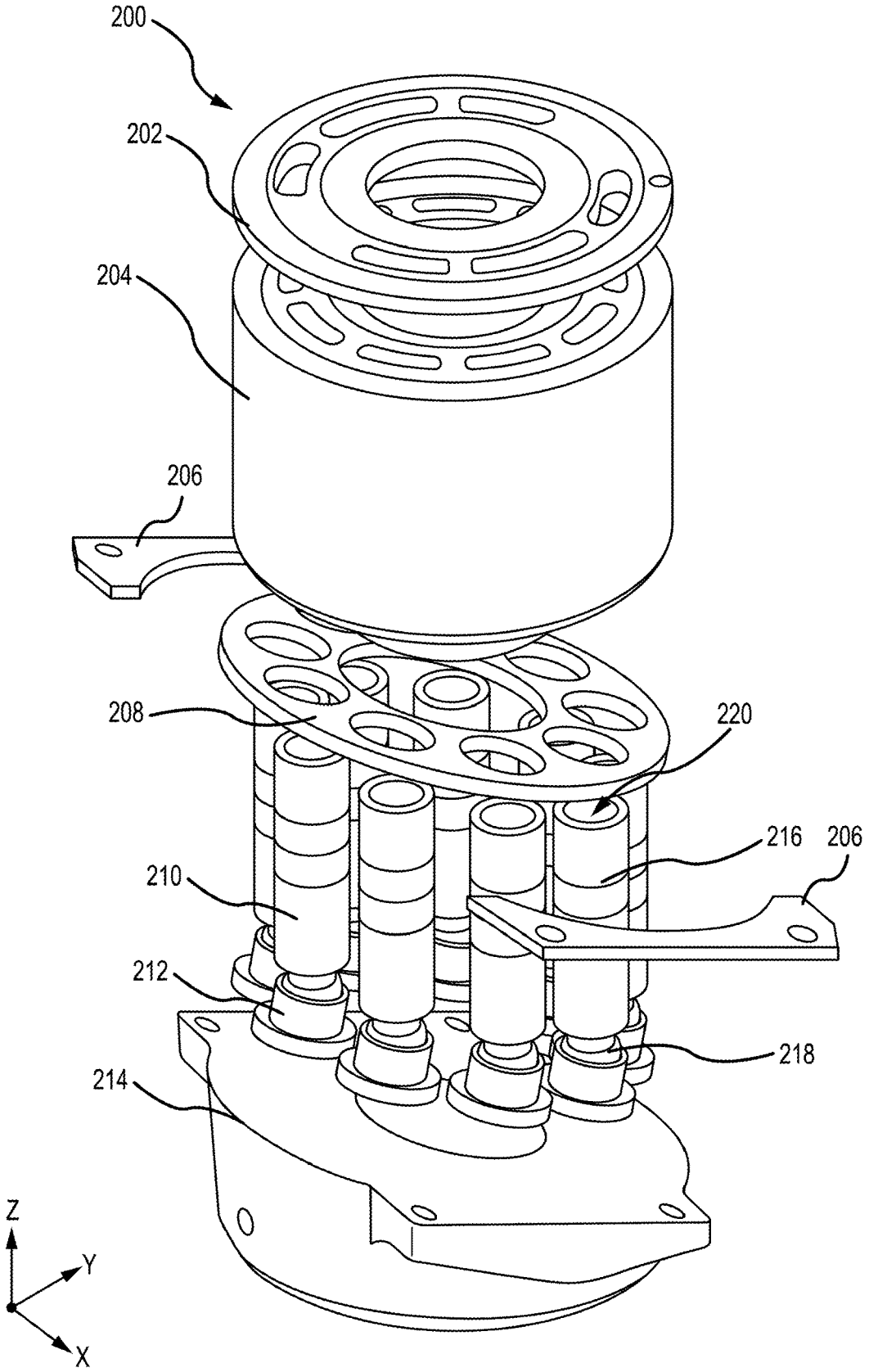
FIG. 2 illustrates an exploded perspective view of a portion of a hydraulic piston pump/motor, in accordance with various embodiments.

Referring now to FIG. 2, an exploded perspective view of a portion of a hydraulic piston motor 200 is illustrated, in accordance with various embodiments. Hydraulic piston motor 200 includes a distributor plate 202, a cylinder block 204, plain bearings 206, a retainer plate 208, a plurality of pistons 210, a plurality of shoes 212, and a swashplate 214. It will be appreciated that only a portion of hydraulic piston motor 200 is illustrated for simplicity and ease of description. Hydraulic piston motor 200 additionally includes an output shaft coupled to cylinder block 204, a hydraulic fluid input, and a hydraulic fluid output, among other components. Each of the plurality of pistons 210 fits through retainer plate 208 and in cylinder block 204. Each of the plurality of pistons 210 is able to extend from cylinder block 204 (e.g., in the negative z-direction) and retract into cylinder block 204 (e.g., in the positive z-direction).

The plurality of shoes 212 are each coupled to a piston 210 of the plurality of pistons and configured to interface with swashplate 214. The plurality of shoes 212 contact a surface of swashplate 214 and slide along the surface of swashplate 214. The surface of swashplate 214 is angled from a reference plane (e.g., the x-y plane) so that as the plurality of pistons 210 each extend they exert a downward force (e.g., in the negative z-direction) causing cylinder block to rotate. For example, cylinder block 204 may rotate in a clockwise direction in response to pistons 210 in the foreground of FIG. 2 (e.g., in the positive x-direction) extending (e.g., in the negative z-direction) and pistons 210 in the background (e.g., in the negative x-direction) retracting (e.g., in the positive z-direction). Cylinder block 204 may rotate in a counterclockwise direction in response to pistons 210 in the background of FIG. 2 (e.g., in the negative x-direction) extending (e.g., in the negative z-direction) and pistons 210 in the foreground (e.g., in the positive x-direction) retracting (e.g., in the positive z-direction).

The plurality of pistons 210 and the plurality of shoes 212 may exert a large amount of force on the surface of swashplate 214. This force tends to increase the friction between shoes 212 and swashplate 214, thereby increasing wear on both the plurality of shoes 212 and swashplate 214. Hydrostatic pressure may be used to reduce the force exerted by each piston 210, and therefore each shoe 212, on swashplate 214.

Each piston 210 of the plurality of pistons 210 includes a shaft 216, a spherical head 218, and a channel 220. Channel 220 extends the length of piston 210, including shaft 216 and spherical head 218, and into shoe 212. Each of the plurality of shoes 212 is circular in shape and coupled to spherical head 218. This configuration allows each of the plurality of shoes 212 to change its angle with respect to piston 210 as it moves along swashplate 214 in order to maintain contact with swashplate 214. Hydraulic fluid may flow through channel 220 and into shoe 212 to balance the force of shoe 212 against swashplate 214. Balancing the force using the hydraulic fluid tends to decrease the friction between shoe 212 and swashplate 214. In systems such as these, hydraulic fluid tends to leak through shoe 212 and onto swashplate 214. The balancing pressure and/or force of the hydraulic fluid through shoe 212 tends to be about 80% to about 90% balanced. If too little balancing pressure and/or force is applied (i.e., <80%) the friction increase reduces the usable life of shoe 212 and swashplate 214. If too much balancing pressure and/or force is applied (i.e., >100%) shoe 212 loses contact with swashplate 214 and internal leakage increases greatly. Balancing force is a function of the balance pressure and the balancing area on the bottom of the shoe.

Figures 3A, 3B:
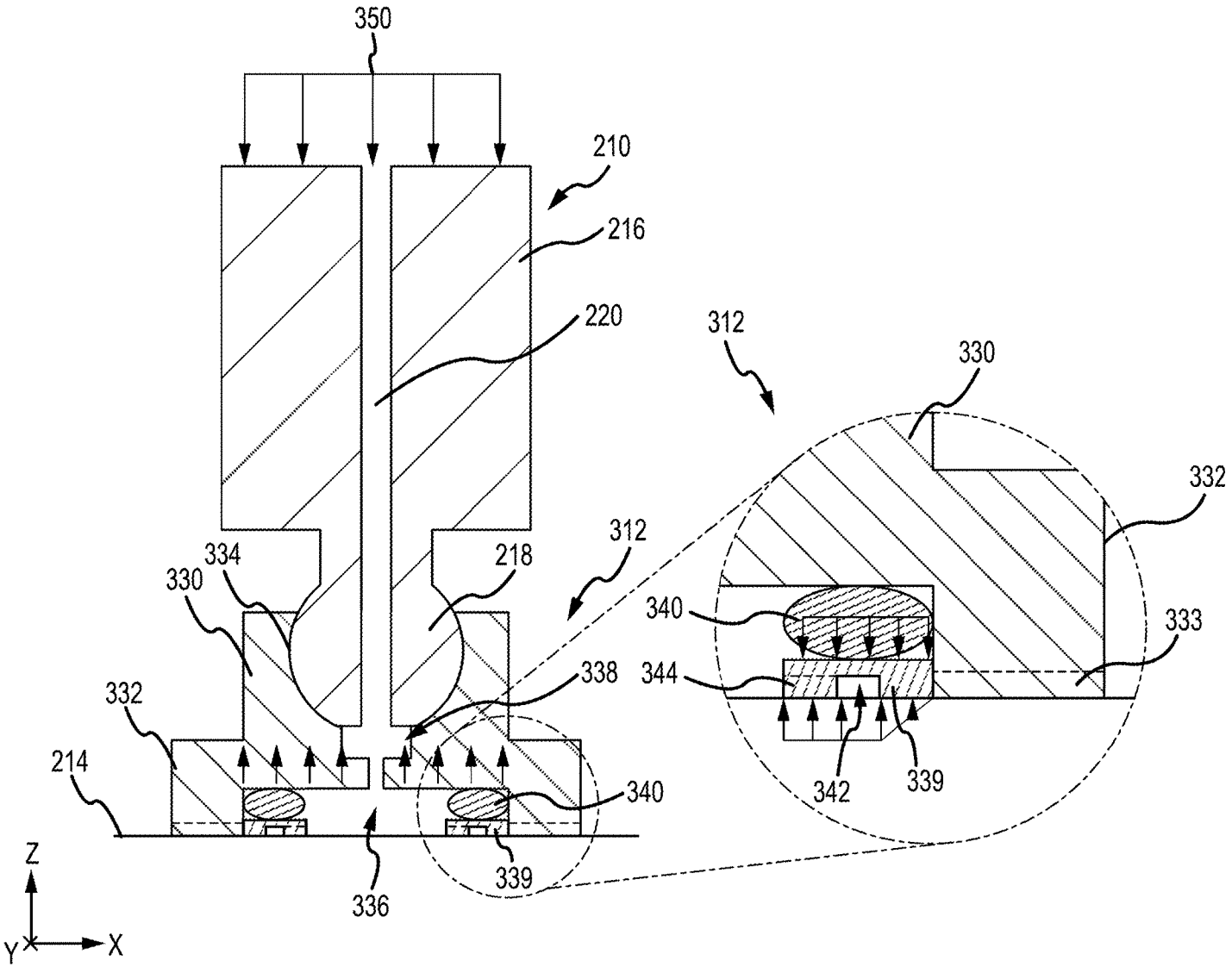
FIGS. 3A and 3B illustrate a piston and shoe for use in a hydraulic piston pump/motor, in accordance with various embodiments.

Referring now to FIGS. 3A and 3B, a cross section view of a shoe 312 for use with a hydraulic piston motor or pump is illustrated, in accordance with various embodiments. In various embodiments, shoe 312 may be an example of shoe 212 used with hydraulic piston motor 200 in FIG. 2. In various embodiments, shoe 312 may be used in nose landing gear hydraulic piston motor. FIG. 3A illustrates a cross section of shoe 312 with piston 210 and FIG. 3B illustrates a close up cross section of a portion of shoe 312.

Shoe 312 includes an upper portion 330, a lower portion 332, one or more channels 333, a spherical receiver 334 formed in upper portion 330, a counterbore 336 formed in lower portion 332, and a vertical channel 338 extending through spherical receiver 334 and into counterbore 336. Spherical receiver 334 is configured to receive spherical head 218 of piston 210. Upper portion 330 is cylindrical in shape, having a circular cross section, and a first diameter. Lower portion 332 is cylindrical in shape, having a circular cross section, and a second diameter that is greater than the first diameter. Counterbore 336 is cylindrical in shape, having a circular cross section, and a third diameter that is less than the second diameter. In various embodiments, the third diameter is greater than the first diameter. The third diameter is an inner diameter of lower portion 332 that is defined by counterbore 336.

Shoe 312 further includes a face seal 339 and an elastomeric seal 340 configured to reduce and/or prevent fluid leakage through shoe 312. In various embodiments, face seal 339 is annular, or donut, shaped. That is, face seal 339 has an outer diameter and an inner diameter with an opening or slot through face seal 339 in the inner diameter. Face seal 339 is placed inside counterbore 336 of shoe 312 and adjacent the inner diameter of lower portion 332. Face seal 339 is configured to contact swashplate 214. Accordingly, face seal 339 may be formed from one or more low friction materials. In various embodiments, face seal 339 may include polytetrafluoroethylene (PTFE; commonly sold under the trade name Teflon®), perfluoro alkoxy (PFA), tetrafluorethyline-perpfluoropropyline (FEP), or other low friction materials.

Face seal 339 further includes a groove 342 and one or more channels 344. Groove 342 is formed around a middle circumference of face seal 339 in a lower portion of face seal 339 (e.g., in the negative z-direction). That is, groove 342 extends from a bottom surface of face seal 339 into a center of face seal 339 but does not extend through face seal 339. The one or more channels 344 are formed from the inner circumference of face seal 339 to groove 342. The hydraulic fluid flows through the one or more channels 344 and into groove 342 to provide hydrostatic pressure, similar to the hydrostatic pressure of counterbore 336. This tends to balance forces of face seal 339 vertically (e.g., along the z-axis) while reducing leakage through shoe 312. In various embodiments, two channels 344 may each be offset 180° from each other. In various embodiments, four channels 344 may each be offset 90° from each other. In various embodiments, different numbers of channels 344 may be formed with each channel being offset a different amount from each other channel 344.

Elastomeric seal 340 is placed inside counterbore 336 and between face seal 339 and shoe 312. Elastomeric seal 340 is configured to provide a mechanical pressure on face seal 339 which tends to maintain pressure of face seal 339 against swashplate 214. In various embodiments, elastomeric seal 340 may include natural rubber, polyurethane, acrylonitrile butadiene rubber, silicone rubber, among other elastomeric materials. In various embodiments, elastomeric seal 340 may be formed as an O-ring. In various embodiments, elastomeric seal 340 is preloaded. That is, face seal 339 applies a force on elastomeric seal 340 (e.g., in the positive z-direction) causing elastomeric seal 340 to compress. The compression of elastomeric seal 340 applies a force on face seal 339 (e.g., in the negative z-direction) which tends to improve contact between face seal 339 and swashplate 214.

The one or more channels 333 are configured to release trapped pressure, if any, between face seal 339 and lower portion 332 of shoe 312. The one or more channels 333 are formed through the outer circumference of lower portion 332 into counterbore 336. That is, each channel 333 extends from the outer diameter of lower portion 332 to the inner diameter, or counterbore 336, of lower portion 332. In various embodiments, the height of each channel 333 is less than the height of cap strip 344. In various embodiments, the height of each channel 333 may be about 25% to about 75% of the height of cap strip 344.

As described herein, in the various embodiments, shoe 312, face seal 339, and elastomeric seal 340 tend to reduce leakage through shoe 312 in low speed applications while also improving the force balance of shoe 312 against swashplate 214. That is, the hydrostatic force in shoe 312 is able to be close to equal to a downward force 350 on piston 210. This balancing tends to reduce wear on shoe 312 and swashplate 214. Additionally, the balanced forces tend to be normalized by face seal 339 so that the thickness of shoe 312 may be smaller and/or more pressure may be applied to shoe 312 by piston 210. Other benefits will be apparent to those skilled in the art.

Figures 4A, 4B:
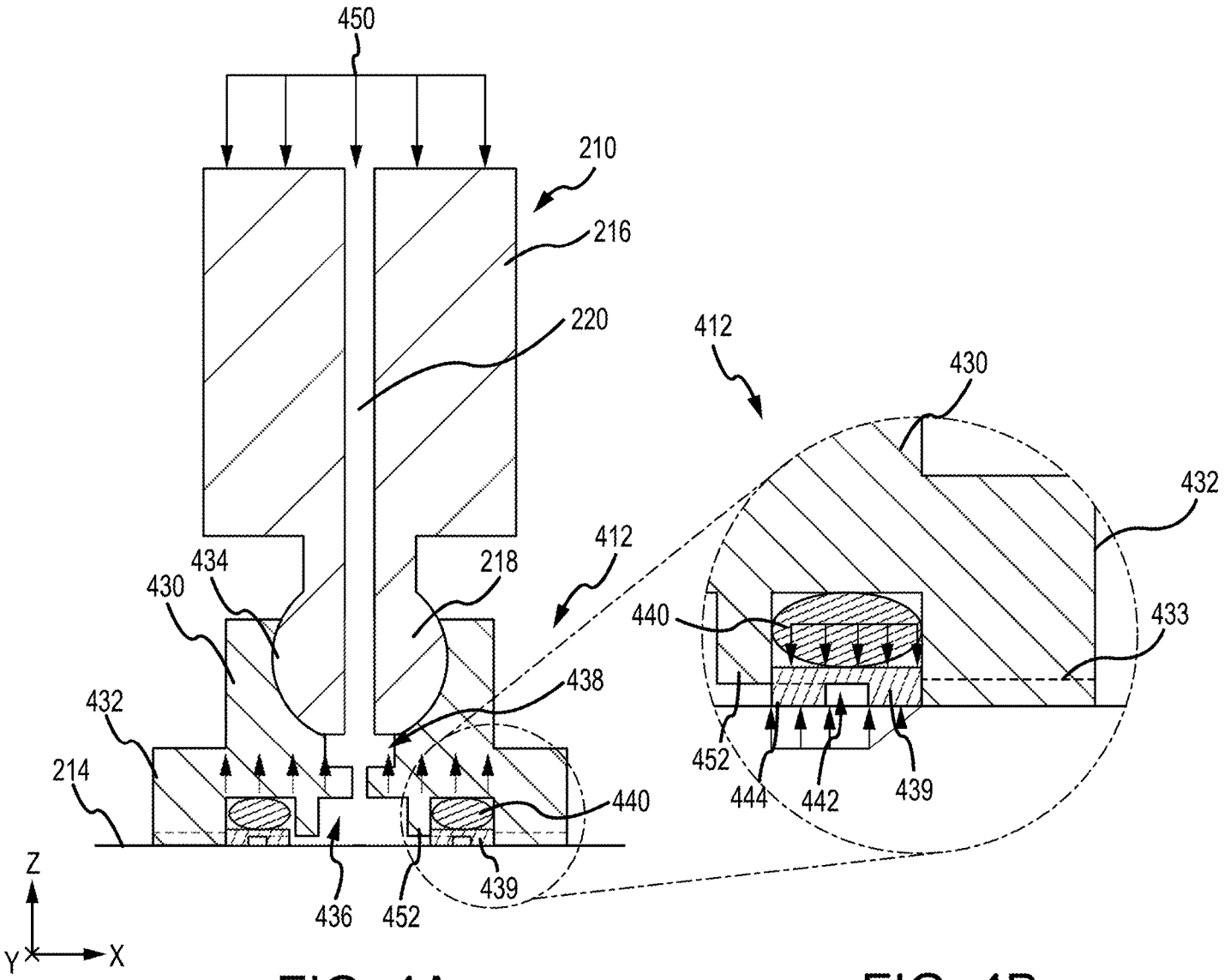
FIGS. 4A and 4B illustrate a piston and shoe for use in a hydraulic piston pump/motor, in accordance with various embodiments.

Referring now to FIGS. 4A and 4B, a cross section view of a shoe 412 for use with a hydraulic piston motor or pump is illustrated, in accordance with various embodiments. FIG. 4A illustrates a cross section of shoe 412 with piston 210 and FIG. 4B illustrates a close up cross section of a portion of shoe 412. Shoe 412 includes similar components to shoe 312 described above in FIGS. 3A and 3B including an upper portion 430, a lower portion 432, one or more channels 433, a spherical receiver 434, a counterbore 436, a vertical channel 438, a face seal 439, an elastomeric seal 440, a groove 442, and one or more channels 444. Shoe 412 further includes an extension 452.

Extension 452 is integral with shoe 412. That is, extension 452 is monolithic with shoe 412. Extension 452 extends downward (e.g., in the negative z-direction) into counterbore 436 from a bottom surface of lower portion 432 but does not extend to the full height of lower portion 432. That is, extension 452 does not contact swashplate 214. In various embodiments, extension 452 may be annular in shape, having a circular cross section. In various embodiments, extension 452 may be a continuous ring. In various embodiments, extension 452 may include multiple independent, or discrete, extensions 452 in annular shape that are generally annular in shape though are not continuous. Extension 452 is configured to secure elastomeric seal 440 and face seal 439 from lateral movement (e.g., along the x-y plane).

Figures 5A, 5B:
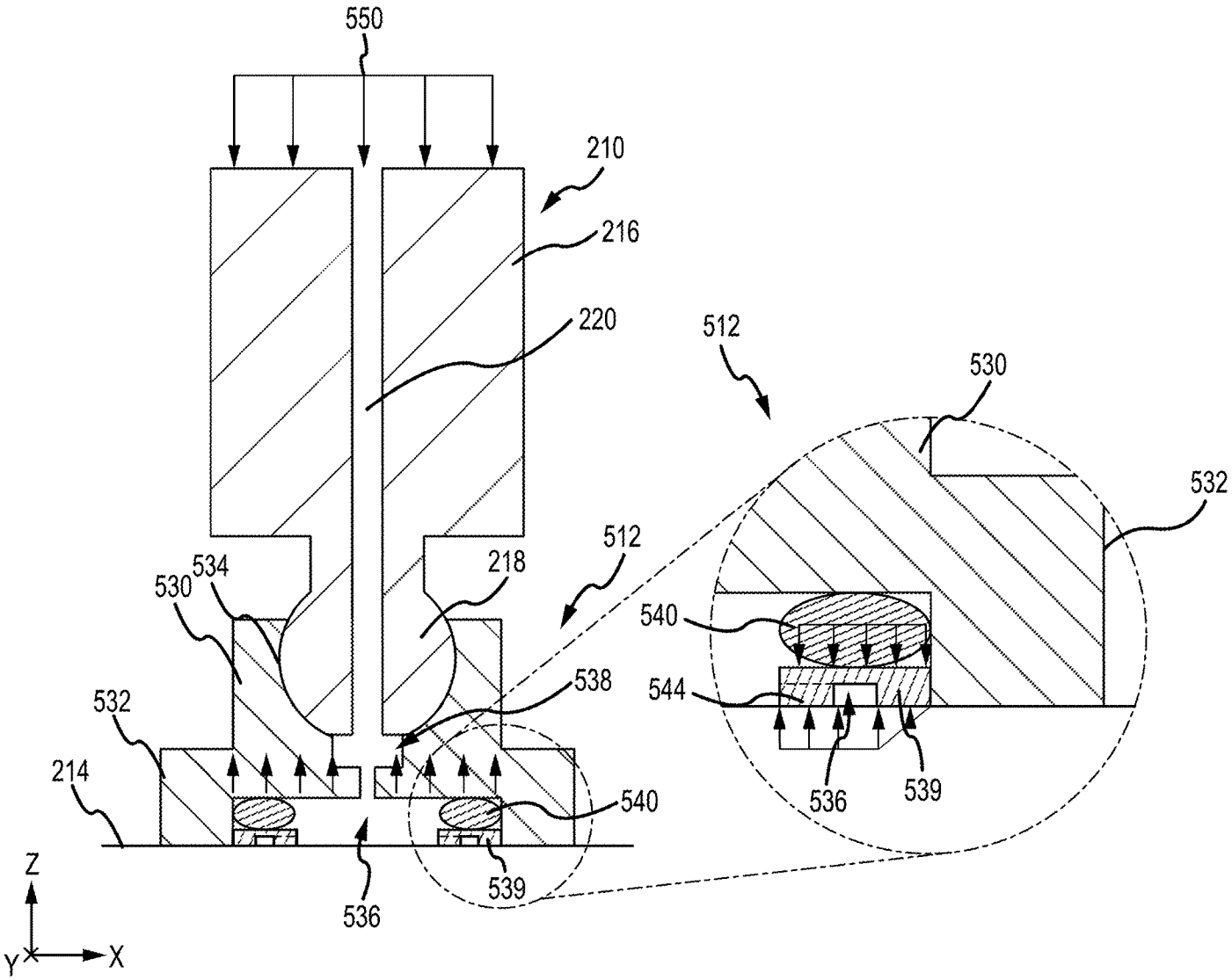
FIGS. 5A and 5B illustrate a piston and shoe for use in a hydraulic piston pump/motor, in accordance with various embodiments.

Referring now to FIGS. 5A and 5B, a cross section view of a shoe 512 for use with a hydraulic piston motor or pump is illustrated, in accordance with various embodiments. FIG. 5A illustrates a cross section of shoe 512 with piston 210 and FIG. 5B illustrates a close up cross section of a portion of shoe 512. Shoe 512 includes similar components to shoe 312 described above in FIGS. 3A and 3B including an upper portion 530, a lower portion 532, a spherical receiver 534, a counterbore 536, a vertical channel 538, a face seal 539, an elastomeric seal 540, a groove 542, and one or more channels 544.

However, unlike shoe 312, shoe 512 does not include the one or more channels formed in lower portion 532 of shoe 512 (i.e., channels 333). Removing the channels removes a potential point of fluid leakage which, in various embodiments, may be significant in low speed hydraulic motors.

Figures 6A, 6B:
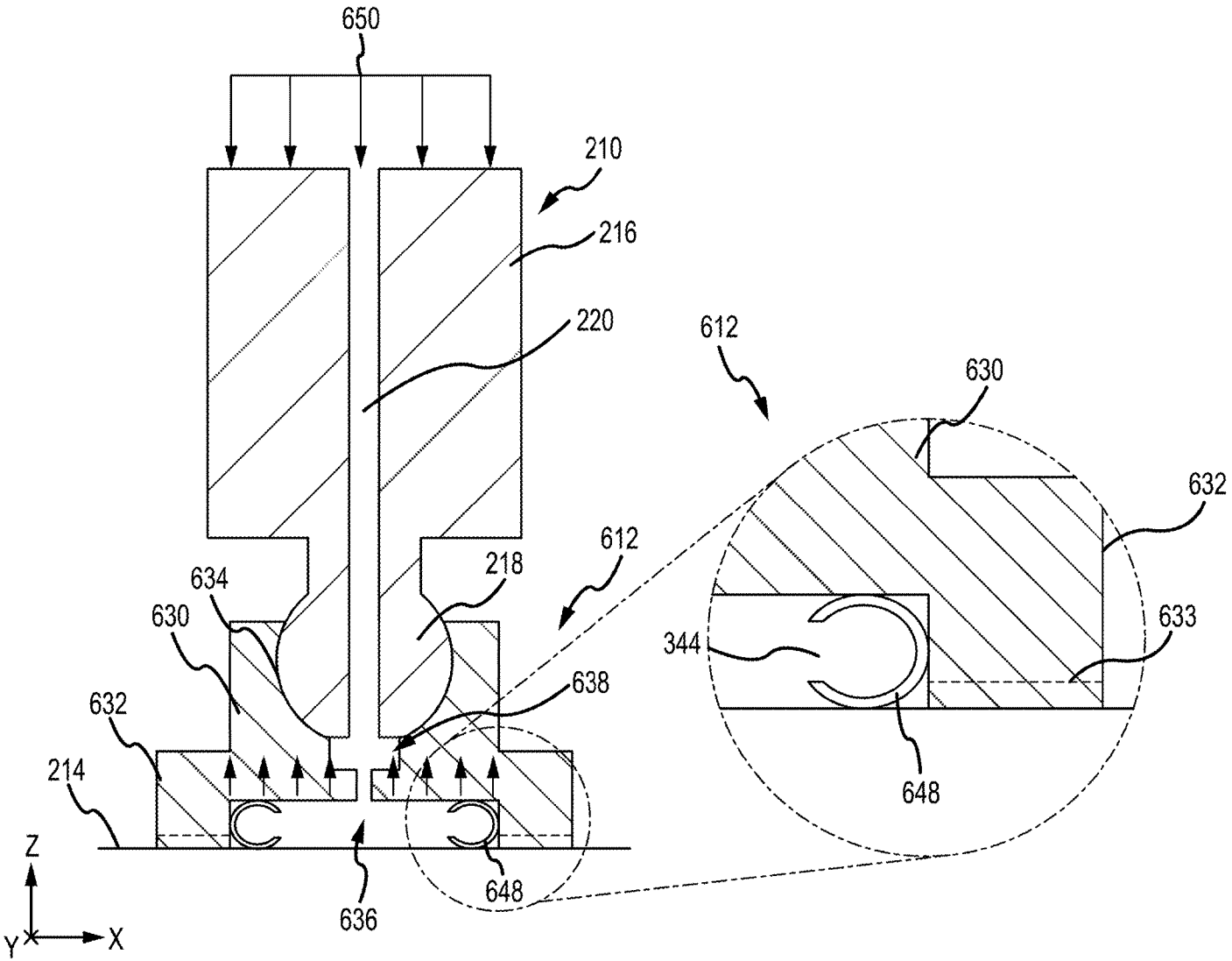
FIGS. 6A and 6B illustrate a piston and shoe for use in a hydraulic piston pump/motor, in accordance with various embodiments.

Referring now to FIGS. 6A and 6B, a cross section view of a shoe 612 for use with a hydraulic piston motor or pump is illustrated, in accordance with various embodiments. FIG. 6A illustrates a cross section of shoe 612 with piston 210 and FIG. 6B illustrates a close up cross section of a portion of shoe 612. Shoe 612 includes similar components to shoe 312 described above in FIGS. 3A and 3B including an upper portion 630, a lower portion 632, one or more channels 633, a spherical receiver 634, a counterbore 636, a vertical channel 638. Shoe 612 further includes an elastomeric, metallic, or polymeric seal 648 energized by differential pressure and by an O-ring or metallic spring positioned within the "C" cross-section of the seal 648.

Seal 648 is located in counterbore 636. In various embodiments, seal 648 may be a single seal that replaces the combination of a face seal and an elastomeric seal (e.g., face seal 339 and elastomeric seal 340). In various embodiments, seal 648 may be annular to fit within counterbore 636. In various embodiments, seal 648 may be C-shaped, having an opening toward the center of counterbore 636 that allows fluid to enter. In various embodiments, seal 648 may be preloaded. That is, seal 648 may be compressed in response to shoe 612 coming into contact with swashplate 214. In various embodiments, seal 648 may include polytetrafluoroethylene (PTFE; commonly sold under the trade name Teflon®), perfluoro alkoxy (PFA), tetrafluorethyline-perpfluoropropyline (FEP), or other low friction materials. In various embodiments, elastomeric seal 648 may additionally, or in the alternative, include natural rubber, polyurethane, acrylonitrile butadiene rubber, silicone rubber, among other elastomeric materials.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods, and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Numbers, percentages, or other values stated herein are intended to include that value, and also other values that are about or approximately equal to the stated value, as would be appreciated by one of ordinary skill in the art encompassed by various embodiments of the present disclosure. A stated value should therefore be interpreted broadly enough to encompass values that are at least close enough to the stated value to perform a desired function or achieve a desired result. The stated values include at least the variation to be expected in a suitable industrial process, and may include values that are within 5% of a stated value. Additionally, the terms "substantially," "about" or "approximately" as used herein represent an amount close to the stated amount that still performs a desired function or achieves a desired result. For example, the term "substantially," "about" or "approximately" may refer to an amount that is within 5% of a stated amount or value.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above-described concepts can be used alone or in combination with any or all of the other above-described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A shoe for use with a hydraulic piston, comprising:
an upper portion configured to receive the hydraulic piston;
a lower portion configured to contact a swashplate;
a counterbore formed in the lower portion;
a vertical channel extending through the upper portion and the lower portion into the counterbore; and
a seal disposed within the counterbore and extending around a circumference of the counterbore, wherein the seal is a C-shaped seal, the C-shaped seal having an opening toward a center of the counterbore.

2. The shoe of claim 1, wherein the C-shaped seal is comprised of a low friction material.

3. The shoe of claim 1,
wherein the vertical channel is formed in the lower portion and extends from an outer wall of the lower portion to the counterbore.

4. The shoe of claim 1, further comprising:
an extension that extends into the counterbore from an upper surface of the counterbore, wherein the extension is annular, wherein the seal is disposed between the extension and an outer wall of the counterbore, and the extension is configured to prevent lateral movement of the seal.

5. The shoe of claim 4, wherein the extension includes a plurality of discrete extensions.

6. The shoe of claim 1, wherein:
the upper portion is cylindrical having a first diameter,
the lower portion is cylindrical having a second diameter that is greater than the first diameter, and
the counterbore has a third diameter that is less than the second diameter.

7. A hydraulic piston motor, comprising:
a swashplate;
a plurality of pistons configured to engage the swashplate; and
a plurality of shoes disposed between the swashplate and the plurality of pistons, wherein each shoe includes:
an upper portion configured to receive a piston of the plurality of pistons;
a lower portion configured to contact the swashplate;
a counterbore formed in the lower portion;
a vertical channel extending through the upper portion and the lower portion into the counterbore; and
a seal disposed within the counterbore and extending around a circumference of the counterbore, wherein the seal is a C-shaped seal, the C-shaped seal having an opening toward a center of the counterbore.

8. The hydraulic piston motor of claim 7, wherein the C-shaped seal includes a low friction material.

9. The hydraulic piston motor of claim 7,
wherein the vertical channel is formed in the lower portion and extends from an outer wall of the lower portion to the counterbore.

10. The hydraulic piston motor of claim 7, further comprising:
an extension that extends into the counterbore from an upper surface of the counterbore, wherein the extension is annular, wherein the seal is disposed between the extension and an outer wall of the counterbore, and the extension is configured to prevent lateral movement of the seal.

11. The hydraulic piston motor of claim 10, wherein the extension includes a plurality of discrete extensions.

12. The hydraulic piston motor of claim 7, wherein:
the upper portion is cylindrical having a first diameter,
the lower portion is cylindrical having a second diameter that is greater than the first diameter, and
the counterbore has a third diameter that is less than the second diameter.

13. A shoe for use with a hydraulic piston, comprising:
an upper portion configured to receive the hydraulic piston;
a lower portion configured to contact a swashplate;
a counterbore formed in the lower portion;
a vertical channel extending through the upper portion and the lower portion into the counterbore; and
a seal disposed within the counterbore and extending around a circumference of the counterbore, wherein the seal includes a face seal and an elastomeric seal, wherein the face seal is configured to contact the swashplate and the elastomeric seal is disposed between the face seal and the lower portion and wherein the face seal is annular having an inner circumference and an outer circumference, the face seal including:
a groove formed around a middle circumference of the face seal, the middle circumference being between the inner circumference and the outer circumference; and
a face seal channel extending from the inner circumference to the groove.

14. The shoe of claim 13, wherein the face seal is comprised of a low friction material.

15. The shoe of claim 13, wherein the vertical channel is formed in the lower portion and extends from an outer wall of the lower portion to the counterbore.

16. The shoe of claim 13, further comprising:
an extension that extends into the counterbore from an upper surface of the counterbore, wherein the extension is annular, wherein the seal is disposed between the extension and an outer wall of the counterbore, and the extension is configured to prevent lateral movement of the seal.

17. The shoe of claim 16, wherein the extension includes a plurality of discrete extensions.

18. The shoe of claim 13, wherein:
the upper portion is cylindrical having a first diameter, the lower portion is cylindrical having a second diameter that is greater than the first diameter, and the counterbore has a third diameter that is less than the second diameter.

* * * * *